United States Patent [19]

Myers et al.

[11] Patent Number: 4,979,872

[45] Date of Patent: Dec. 25, 1990

[54] BEARING COMPARTMENT SUPPORT

[75] Inventors: Richard S. Myers, Palm Beach Gardens; Perry P. Sifford, Jupiter, both of Fla.

[73] Assignee: United Technologies Corporation, Hartford, Conn.

[21] Appl. No.: 370,201

[22] Filed: Jun. 22, 1989

[51] Int. Cl.[5] ..... F01D 25/16

[52] U.S. Cl. ..... 415/142; 415/201; 403/131; 403/168; 411/383; 411/537

[58] Field of Search ..... 415/142, 201, 214.1, 415/216.1, 118; 60/39.31, 39.75; 411/537, 383, 121, 124; 403/167, 168, 131, 158

[56] References Cited

U.S. PATENT DOCUMENTS

| | | | |
|---|---|---|---|
| 2,869,941 | 1/1959 | Shoup, Jr. et al. | 415/142 |
| 2,941,781 | 6/1960 | Boyum | 415/142 |
| 3,403,889 | 10/1968 | Crokajlo | 415/118 |
| 4,373,309 | 2/1983 | Lutz | 403/168 |
| 4,478,551 | 10/1984 | Honeycutt, Jr. et al. | 415/142 |
| 4,491,436 | 1/1985 | Easton | 403/131 |
| 4,815,276 | 3/1989 | Hansel et al. | 415/118 |
| 4,916,942 | 4/1990 | Davidson | 415/118 |

*Primary Examiner*—John T. Kwon

[57] ABSTRACT

The support structure for the bearing compartment for a gas turbine engine includes eight radial tie bolts connected with the clevis wherein the outer diameter clevis is connected to the mount ring with an accessible bolt for easy assembly and disassembly. The tie bolts, while preloaded in tension, can accept compressive loads during severe loading operation conditions. The turbine exhaust case housing the tie bolts and bearing compartment are designed to facilitate cooling and maintainability at reduced costs.

7 Claims, 3 Drawing Sheets

BEARING COMPARTMENT SUPPORT

This invention was made under a Government contract and the Government has rights herein.

TECHNICAL FIELD

This invention relates to gas turbine engines and particularly to the construction of the bearing support structure.

BACKGROUND ART

As is well-known, one of the purposes of the turbine exhaust case and the support rods is to support the engine's bearings and its compartment that rotatably support the engine's shafts. Typically, the turbine exhaust case comprises a pair of concentric rings and a plurality of hollow struts which support the rings to each other. The rings define the inner and outer boundaries of the engine's gas path while the struts are disposed in the gas path. The rods, supporting the bearing housing, pass through the hollow struts to interconnect the mount ring and bearing compartment. Inasmuch as the temperature of the gases in the gas path are significantly high, it is abundantly important to design these component parts to assure durability while maintaining structural integrity. Obviously, as the engine's performance and maintainability are being improved upon, it is also important that the components are easily assembled and disassembled while maintaining costs as low as possible.

Of the heretofore known bearing support mount systems for various existing engines, each exhibits disadvantages some of which are discussed hereinbelow and which are attempted to be obviated by the present invention.

For example, in many installations, the tie rods that support the bearing compartment to the outer mount ring are installed with a significantly high tension load. In order to attain these high tension loads, it is common practice to compress the outer mount ring supporting the turbine exhaust case by use of external high powered hydraulic jacks specifically designed for this purpose. When the load is applied to the outer mount ring, the rods are manually torqued down into place with the desired preload and the jacks are thereafter removed. In addition to being expensive tooling, the use of these heavy duty jacks expose the operator to some safety risks. Moreover, each rod must always be in tension and can never be in compression without incurring damage to the hardware.

In some installations, a complex double rod system is employed. Radial rods tie the bearing compartment to the outer exhaust case and tangential rods tie these radial rods from the turbine exhaust case to the outer engine case or mount ring.

In other installations, disassembly is cumbersome. For example, the outer engine casing has to be removed in order to access the nut and bolt assembly that secure these tie rods. In order to be able to remove the low pressure turbine assembly, these nuts have to be first removed. Other installations include external access to the nut and bolt assembly, but require that the entire rod be removed before the low pressure turbine module can be removed.

Obviously, in each of these instances the assembly and disassembly makes for a cumbersome and time consuming task. In a business environment where such time consuming tasks are costly, improvements in this area are much sought after.

We have found that we can obviate the problems noted above by attaching the double eye rod (radial support rod) used to support the bearing housing to the engine's mount ring by utilizing a clevis pivotally attached to the eye rod and a standard bolt attaching the clevis to the mount ring. These radial support rods in accordance with this invention can then be tightened with a standard torque wrench without the need of the hydraulic jack. By virtue of this arrangement the typical spherical bearings associated with the radial support rods are manually torqued with a standard torque wrench without the twisting and galling that has occurred heretofore, eliminating a problem that heretofore was expensive and time consuming to avoid, while at the same time eliminating the safety problems inherent in these problem solving techniques.

We have also found that by utilizing a high strength low expansion type of nickel base alloy material, such as PWA 1192, or having characteristics similar thereto, and designing the mount system such that the rods can take compressive loads under certain severe loading conditions, the torque loading at assembly can be minimized.

In a turbofan engine installation in accordance with the invention, the fan air is supplied thru the turbine engine case hollow strut thru which the rod passes to maintain rod temperatures at acceptable levels to achieve positive tension under normal operation conditions.

Installation and disassembly are facilitated by virtue of the fact that the clevis at the outside diameter of the radial rod is hinged and swings out of the mount connection. This allows for easy removal of the engine module since the rod need not be removed.

It is contemplated that within the scope of this invention that eight (8) instead of four (4) radial support rods be used so as to attain the proper stiffness and spring rate to match the spring rate of the oil film damping system utilized in a counter-rotating "piggy-back" arrangement of engine's shafts and support bearings supported in the bearing compartment.

The lubricating lines from external of the bearing compartment are arranged to pass through the hollow struts in the turbine exhaust case in such a manner so as to enhance the packaging and maintainability thereof.

The bearing housing is designed so as to be shaped in a quasi "wishbone" configuration that not only provides adequate stiffness, but provides a means to dispose the large thermal gradient between the turbine exhaust case inner ring and oil compartment in the bearing compartment.

It is also contemplated within the scope of this invention that the inner ring of the turbine exhaust case is designed to provide increased stiffness at the transition juncture where the ring attaches to the struts by way of fore and aft rings to reinforce the struts standups. This arrangement also provides increased roll and radial stiffness.

The invention contemplates the inclusion of an inspection hole in the mount ring adjacent the clevis to allow an operator access so as to be able to inspect the assembly after tensioning the rod bolts to assure proper seating.

DISCLOSURE OF THE INVENTION

An object of the invention is an improved mount system for the bearing compartment of a gas turbine engine.

A feature of this invention is an improved radial rod and its attendant connecting members supporting the bearing compartment to the engine's mount ring.

Another feature of this invention is the use of a clevis and a tightening bolt for attaching the rod to the mount ring so that tensioning the rods at assembly is easily accessible and by use of a standard torque wrench.

A still further feature is to hingedly connect the clevis at the outer diameter so that by removal of the externally accessible tightening bolts, the clevis swings away from the mount ring to allow easy removal of the engine's modules, such as the low pressure turbine assembly and the like.

A still further object of this invention is to arrange the lubrication tubes to pass through the hollow struts to enhance their packaging and maintainability.

A still further feature of this invention is to design the cooling system for cooling the rods to communicate the hollow struts housing the radial rods directly with the engine's fan exhaust duct.

A still further feature of this invention is to utilize a high strength low expansion material such as Incoloy 909 (PWA 1192) for fabricating the radial rods.

A still further feature of this invention is to design the bearing compartment housing in a "wishbone" configuration to assure adequate stiffness and provide sufficient thermal gradient between the inner ring of the turbine exhaust case and the oil compartment defined by the bearing housing to completely or as completely as possible dissipate.

A still further feature of this invention is to utilize an eight strut and rod configuration of the turbine exhaust case so as to assure adequate stiffness and spring rate to be compatible with the piggy-back bearing arrangement of the bearings in the bearing compartment supporting the engine's counter-rotating shafts.

A still further feature of this invention is the design of the transition juncture of the struts and inner diameter ring of the turbine exhaust case by way of fore and aft rings to reinforce the struts standups to assure increased roll and radial stiffness.

A still further feature of this invention is to provide an inspection sight hole in the mount ring to assure proper seating of the clevis with respect to the inner surface of the mount ring.

The foregoing and other features and advantages of the present invention will become more apparent from the following description and accompanying drawings.

BEST MODE FOR CARRYING OUT THE INVENTION

Figure 1:
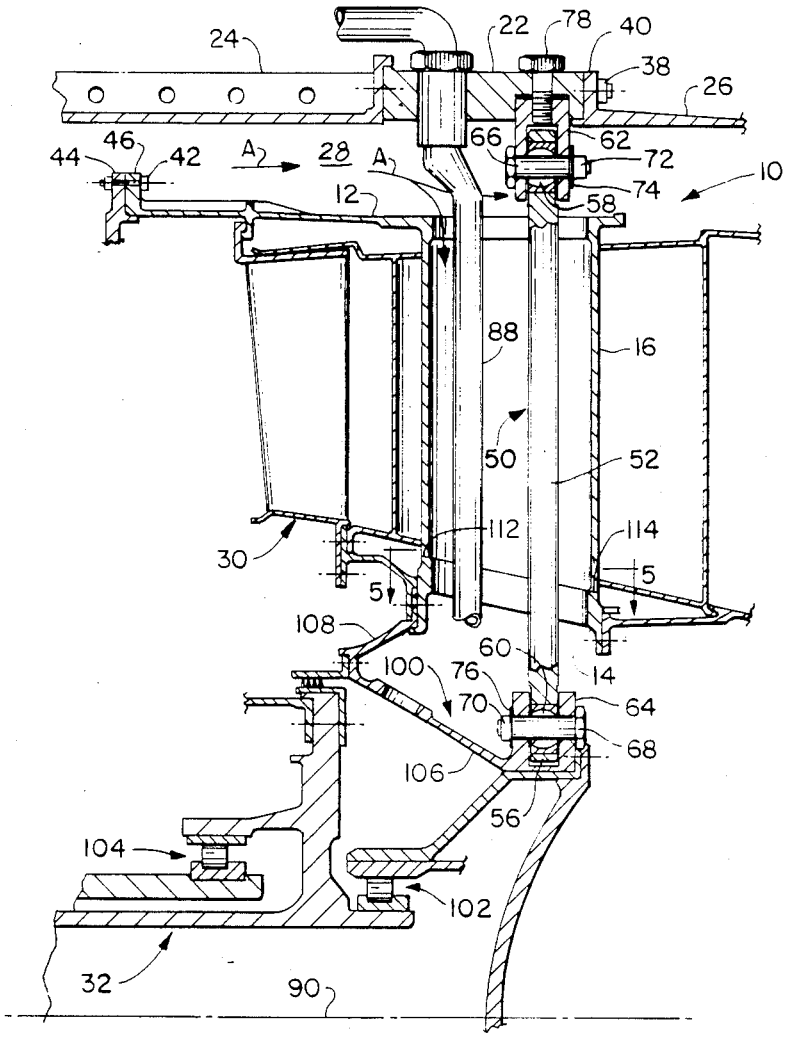
FIG. 1 is a view partly in section and partly in schematic illustrating the turbine exhaust case assembly of a turbofan power plant.
Figure 2:
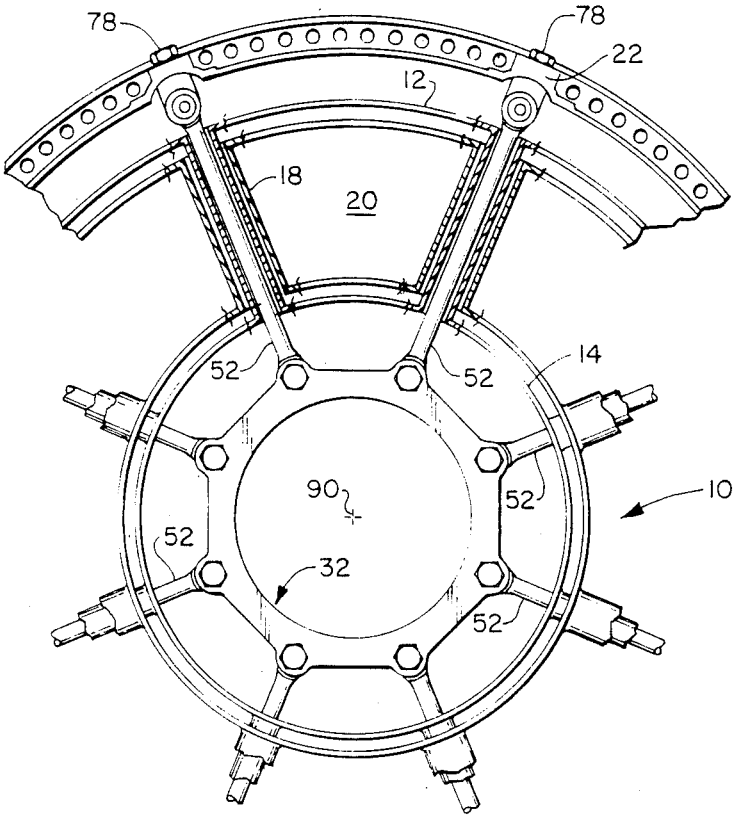
FIG. 2 is an end view partly in elevation and partly in section illustrating the mount system for the bearing compartment.
Figure 3:
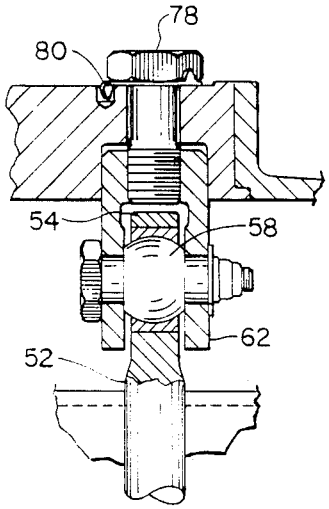
FIG. 3 is an enlarged partial view partly in section showing the details of the connection between the engine mount ring, clevis and radial rod.
Figure 4:
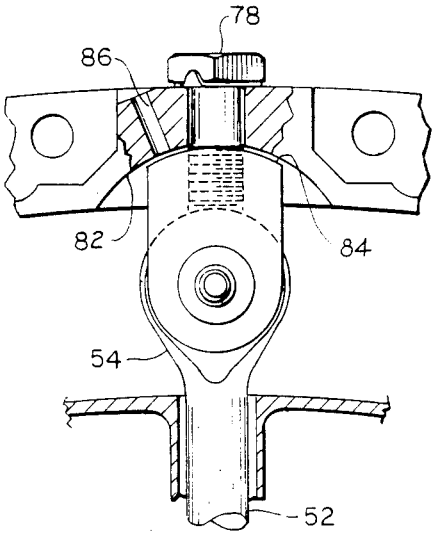
FIG. 4 is a side view partly in section and partly in elevation of the structure in FIG. 3.

While this invention is described in its preferred embodiment as being utilized in a turbofan engine, it is to be understood by those skilled in this art that it has utility in other applications particularly where ease of assembly and disassembly are a consideration. In this light, the invention is particularly efficacious for aircraft engines designed to power relatively high speed aircraft and a good example of the type of engines where the invention could be utilized in is the F-100 family of engines as well as the advanced technology engines manufactured by Pratt & Whitney of United Technologies Corporation which are incorporated herein by reference.

As discussed hereinabove, the invention relates to the mount assembly for the bearing compartment supporting the engine's shaft and particularly to the compartment supported to the engine's mount ring circumscribing the turbine exhaust case.

The invention is best seen in FIGS. 1, 2, 3 and 4 comprising a turbine exhaust case generally illustrated by reference numeral 10 having an outer ring 12 and a concentrically disposed inner ring 14 and a plurality of hollow struts 16 circumferentially spaced and supporting the inner and outer rings 12 and 14. Aerodynamically shaped fairing 18 encapsulating the struts 16, inner ring 12 and outer ring 14 may be used and serves as the boundary for defining the engine's gas path passing through openings 20 of the turbine exhaust case. An application Ser. No. 354,060 filed on May 19, 1989 by Richard S. Myers and Peter T. Vercellone entitled "Replaceable Fairing for a Turbine Exhaust Case" assigned to United Technologies Corporation, the assignee common to this patent application shows detail of suitable fairing.

In this particular installation, the turbine exhaust case 10 is mounted within the mount ring 22 which is sandwiched between the fan duct 24 and the augmentor duct 26. The annular space or passageway 28 defined between the outer ring 12 and the inner diameter of fan duct 24, mount ring 22 and augmentor duct define a flow path for the air discharging from the fan (not shown).

In the core portion of the engine, i.e., the structure defining the gas path, the turbine exhaust case 10 serves to support the stator vane assembly 30 and the bearing compartment generally illustrated by reference numeral 32.

What has been described above save for the details of the turbine exhaust case 10 is well known structure and for the sake of simplicity and convenience, details of the actual construction is omitted herefrom and for further details, reference should be made to the F-100 family of engines, supra.

Suffice it to say that the turbine exhaust case 10 including the stator vane structure are fabricated in a module design so that it can be removed as an integral unit. To remove this module, the operator merely has to unfasten the bolts 38 (one being shown) circumferentially spaced about flange 40 of augmentor duct 26 and the bolts 42 (one being shown) circumferentially spaced about cooperating flanges 44 and 46.

As will be explained in further detail hereinbelow, heretofore it was necessary to remove the rods interconnecting the bearing compartment and mount ring. As mentioned earlier, this complex procedure is no longer necessary.

In accordance with this invention, the rods 50 connecting the bearing compartment 32 to the mount ring 22 comprises a rod portion 52 and a pair of eye portions 54 and 56 carried on either end thereof. Spherical bearings 58 and 60 are supported in each eye 54 and 56 and are pinned to clevis 62 and 64, respectively. Suitable pin bolts 66 and 68 serve to support bearings 58 and 60 and hingedly connect the rod 50 to the clevis 62 and 64. The pin bolts are secured by nuts 70 and 72 and washers 74 and 76 may be included.

In accordance with this invention, the radial rod/clevis assembly is attached to the mount ring by a plurality of bolts 78 accessible externally of the mount ring and readily accessible to the assembler. These bolts 78 (two being shown) which are circumferentially spaced about the mount ring 22 serve to connect the radial rods to U mount rings 22 and tightening these bolts serve to preload the bolts with the desired tension. In this arrangement, the assembler can torque down these bolts to the desired torque level by use of a standard commercially available torque wrench. A suitable tab washer 80 may be utilized to assure the bolt does not inadvertently retract.

The inner diameter of mount ring 22 is recessed defining a concave surface 82 that compliments the contour 84 formed on the end of clevis 62. To assure proper seating of these surfaces at assembly an inspection hole 86 is provided that would accept a suitable depth gage.

As mentioned above, removal of the low pressure turbine module is facilitated since all that is necessary is to retract bolt 78 and swing clevis 62 away from the recess in the mount ring, thus having the radial support rods in place. As viewed in FIG. 1, clevis 62 would pivot about spherical bearing 58 in the direction that would appear as being in and out of the paper.

The lubricating lines (one being shown) are located in such a way as to provide easy packaging and maintainability since it is nested adjacent the rod and passes through the hollow of struts 16.

The radial support rods are readily cooled since the outer diameter of struts 16 extend in the fan discharge air flow path. Hence, as shown by arrows labeled A, a portion of the fan discharge air flows through the hollow strut 16 toward the engine's center line 90.

As can be seen in FIG. 1, the housing 100 for the bearing compartment which houses the piggy-back arrangement of bearings 102 and 104 is designed in cross section to resemble a "wishbone". As noted, the housing is designed so that one leg 106 of housing 100 attaches to the inner diameter clevis 64 and the other leg 108 attaches to the fore ring 110 of the turbine exhaust case 10. The "wishbone" design assures adequate stiffness while providing sufficient thermal gradient between the inner ring of the turbine exhaust case 10 and the bearing compartment housing 100. By this arrangement, the heat emanating from the engine's gas path passing through the turbine exhaust case will be completely, or nearly so, dissipated before reaching the bearing compartment.

Figure 5:
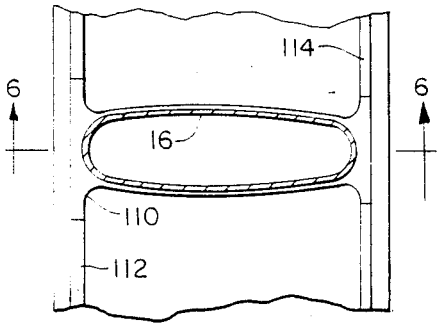
FIG. 5 is a view in section taken along lines 5—5 of FIG. 1.
Figure 6:
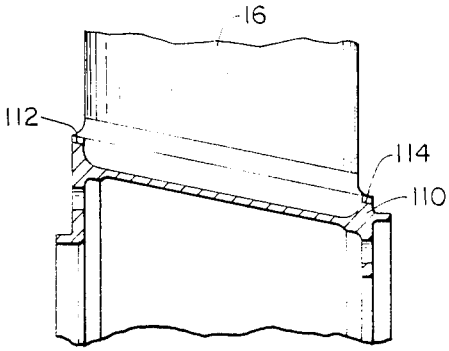
FIG. 6 is a view partly in section taken along lines 6—6 of FIG. 5.

The strut standup 110 best seen in FIGS. 1, 5 and 6 provides an integral gusset-like arrangement which rigidly ties the fore and aft rings, 112 and 114, together. The inner diameter of strut 16 is likewise integral or may be bonded by any suitable means as welding, brazing and the like to the strut standup 110 which as a rigid unit serves to provide increased roll and radial stiffness.

Although this invention has been shown and described with respect to detailed embodiments thereof, it will be understood by those skilled in the art that various changes in form and detail thereof may be made without departing from the spirit and scope of the claimed invention.

We claim:

1. For a gas turbine engine having a turbine section including a bearing rotatably supported in a bearing housing, means for supporting said bearing housing including a turbine exhaust case having an outer ring and an inner ring in concentric and spaced relationship, a plurality of circumferentially spaced hollow struts interconnecting and supporting said inner ring and said outer ring to each other, an outer casing included a mount ring for said engine surrounding said outer ring, a plurality of rods interconnecting said bearing housing and said mount ring, each of said rods including a spherical bearing formed on one end, at least a first clevis hingedly supported at one end of said rod including a spherical ball supported between the U-shaped portion of said clevis, a bolt extending through an opening formed in said mount ring and aligned with a threaded opening formed in said clevis whereby tightening said bolt applies a tension to said rod.

2. For a gas turbine engine as claimed in claim 1 wherein the outer end of said clevis is configured in a convex shape, a recess formed in the inner diameter of said mount ring having an inner surface configured in a concave shape to complement said outer end of said clevis herein said clevis seats on said inner concave surface when in the assembled condition.

3. For a gas turbine engine as claimed in claim 2 wherein said clevis is dimensioned relative to said mount ring such that when said bolt is retracted said clevis swings away from the inner diameter of said mount ring for retracting said turbine exhaust case and said bolt as an integral unit.

4. For a gas turbine engine as claimed in claim 3 including a tab washer fitted underneath the bolt head and supported in the outer diameter of said mount ring for preventing rotation of said bolt when in the assembled position.

5. For a gas turbine engine as claimed in claim 4 wherein said rod is fabricated from Incoloy 909 material.

6. For a gas turbine engine as claimed in claim 3 wherein said turbine exhaust case consists of eight hollow struts and eight rods each passing through one of said hollow struts interconnecting said bearing compartment and said mount ring.

7. For a gas turbine engine as claimed in claim 6 wherein said exhaust case has axially spaced ring members and the inner diameter of each of said eight hollow struts is supported to a strut standup, said strut standup having a pair of end portions attached to said axially spaced ring members and a recess for supporting each of said inner diameters of said struts whereby the radial and roll stiffness of said turbine exhaust case is increased.

* * * * *